United States Patent [19]

Zängerle

[11] 4,413,659

[45] Nov. 8, 1983

[54] APPARATUS FOR FEEDING SPIRAL WIRE SPRINGS FROM COILING MACHINES TO A SPRING CORE ASSEMBLY MACHINE

[75] Inventor: Ernst Zängerle, St. Gallen, Switzerland

[73] Assignee: Spühl AG, St. Gallen, Switzerland

[21] Appl. No.: 335,030

[22] Filed: Dec. 28, 1981

[30] Foreign Application Priority Data

Jan. 15, 1981 [DE] Fed. Rep. of Germany ..... 3101014

[51] Int. Cl.[3] ..... B21F 27/00

[52] U.S. Cl. ..... 140/3 CA; 140/92.7; 198/430; 198/448

[58] Field of Search ..... 140/3 CA, 92.1, 92.2, 140/92.3, 92.4, 92.5, 92.6, 92.7, 92.8, 92.9, 92.93, 92.94; 198/430, 448, 626; 29/33 F

[56] References Cited

U.S. PATENT DOCUMENTS

| | | | |
|---|---|---|---|
| 3,386,561 | 6/1968 | Spühl | 198/32 |
| 3,687,259 | 8/1972 | Van Der Winden | 198/448 |
| 3,774,652 | 11/1973 | Sturm | 140/3 CA |
| 4,014,371 | 3/1977 | Walker et al. | 140/3 CA |

*Primary Examiner*—Lowell A. Larson
*Assistant Examiner*—Linda McLaughlin
*Attorney, Agent, or Firm*—Sughrue, Mion, Zinn, Macpeak and Seas

[57] ABSTRACT

Rows of springs are periodically supplied to a mattress spring core assembly machine 7 by a transfer system 6. The springs are taken, in turn, from one of two conveyor belt pairs 4, 5 by the transfer system. The individual springs are produced by spring coiling machines 1, 2 with each machine feeding one conveyor belt pair. By periodically shifting the transfer system 6 its gripping arms 20 can alternately take a row of springs from one or the other conveyor belt pair, thus doubling the overall production rate.

4 Claims, 6 Drawing Figures

APPARATUS FOR FEEDING SPIRAL WIRE SPRINGS FROM COILING MACHINES TO A SPRING CORE ASSEMBLY MACHINE

BACKGROUND OF THE INVENTION

This invention relates to an apparatus for alternately feeding spiral wire mattress or upholstery springs from a pair of merged conveyor belt pairs to a spring core assembly machine.

An apparatus of this general type is disclosed in U.S. Pat. No. 3,386,561. This apparatus operates smoothly, but its production rate is limited by the relatively slow output of the spring coiling machine which produces the individual wire springs. The capacity of the spring core assembly machine is thus not fully utilized, and it could produce a far greater number of spring cores per unit time if the rows of spring could be fed more quickly. This invention is therefore aimed at designing an apparatus of the aforementioned type in which the production rate is considerably increased, particularly doubled.

SUMMARY OF THE INVENTION

According to this invention one conveyor belt pair is provided for each of two spring coiling machines, both feeding a common spring core assembly machine through a novel transfer station. This arrangement also has the advantage that, with the failure of one of the coiling machines, the operation can be maintained at half the maximum production rate, which is still equal to the full production rate of the prior art apparatus.

Since the two conveyor belt pairs must run in parallel and closely adjacent each other in the area of the transfer station, it is expedient to dispose them in a Y configuration with their input ends angled apart. This permits arranging the starting area of the two conveyor belt pairs at a greater distance from each other than at the final or output area. In this way the necessary space for the installation of two spring coiling machines is provided.

This angular arrangement of the conveyor belt pairs would ordinarily result in the springs at the starting area having their longitudinal axes perpendicular to the conveyor belt, but diagonal to the conveyor belt after passing through the juncture point of the Y owing to the relatively different path lengths traversed by the inner and outer belt runs. This problem is avoided by providing an auxiliary outer belt run at the bend of the juncture or rerouting point, which is driven at a faster or "catch up" speed than the inner belt run.

DETAILED DESCRIPTION OF THE PREFERRED EMBODIMENTS

Figure 1:
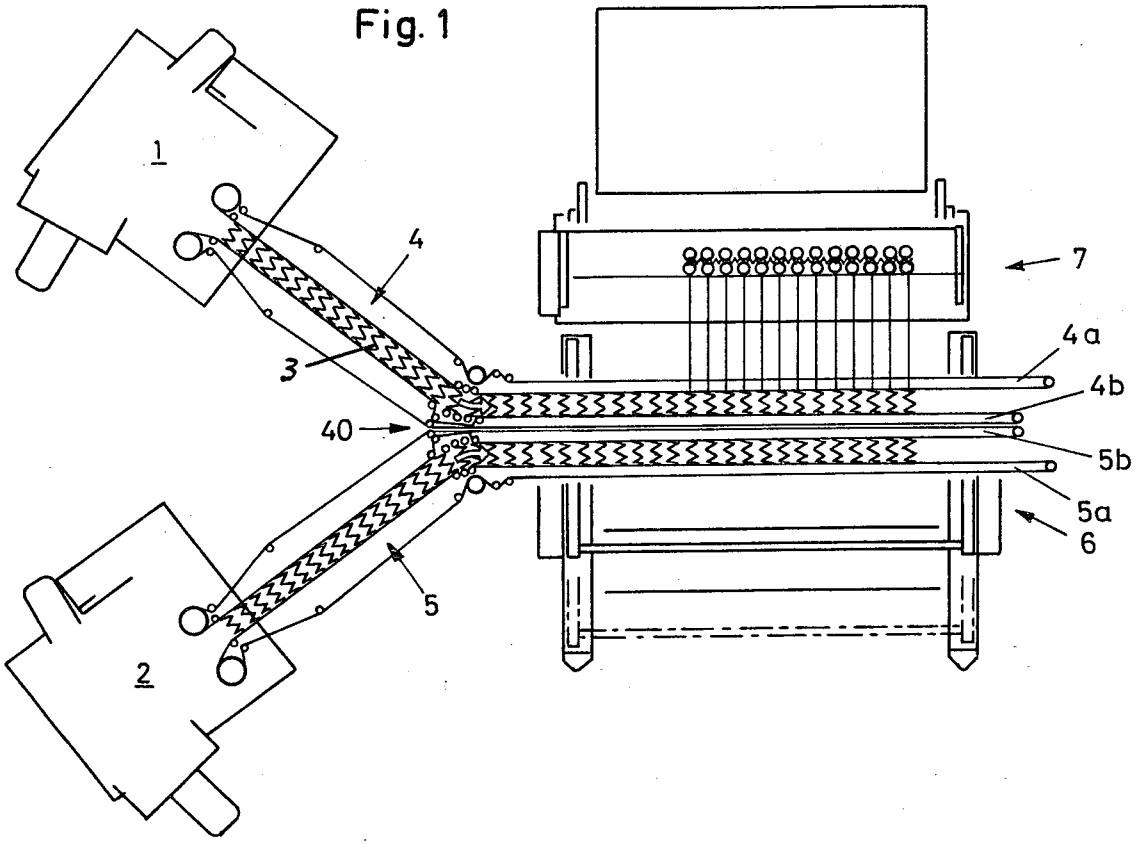
FIG. 1 shows a schematic top view of an entire plant for the production of spring cores with two spring coiling machines, two conveyor belt pairs, a transfer system and a spring core assembly machine.

FIG. 1 shows a complete system for the production of spring cores used for mattresses and upholstery. The two spring coiling machines 1, 2 are of known design. The springs 3 produced by them are introduced, also in a known manner, between the parallel belt portions of the conveyor belt pairs 4 and 5 having belts 4*a*, 4*b* and 5*a*, 5*b*. The two conveyor belt pairs 4, 5 transport the springs 3, which are successively introduced between the parallel belt portions, to a transfer system 6 which transfers them in rows to the spring core assembly machine 7. The springs arranged in rows are combined to form spring cores by means of wire coils, which combine two final coils each of adjacent springs with each other.

The overall operating process and the design of the transfer system are generally described in the above mentioned U.S. Pat. No. 3,386,561 wherein, however, there is only one spring coiling machine and one conveyor belt pair. The present invention thus concerns the adaptation of the conveyor belt pairs with the use of two spring coiling machines 1, 2 and the adaptation of the transfer system.

Figure 2:
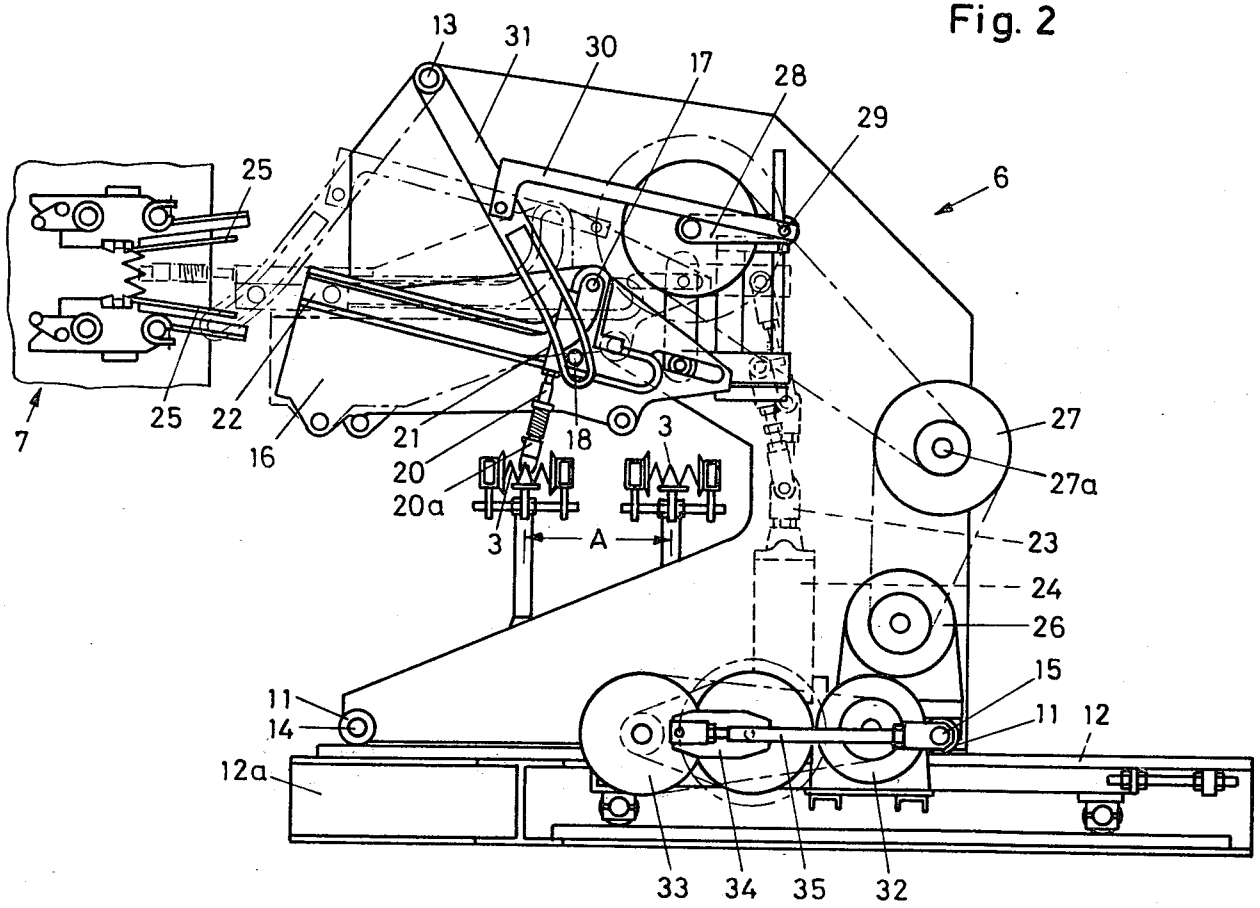
FIG. 2 shows a lateral view of the transfer system with the removal of springs from the first conveyor belt pair.
Figure 3:
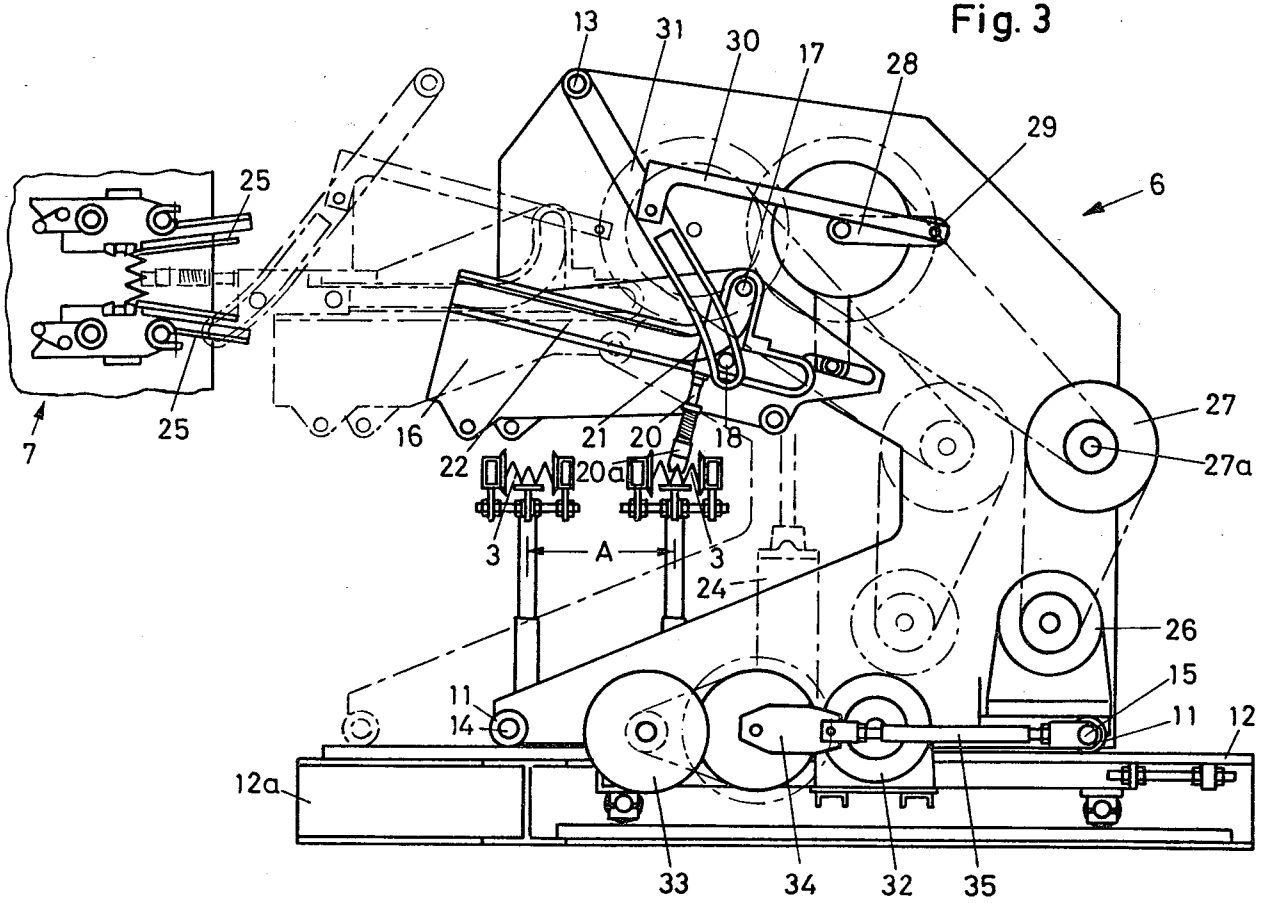
FIG. 3 shows a lateral view similar to FIG. 2 but with the removal of springs from the second conveyor belt pair.
Figure 4:
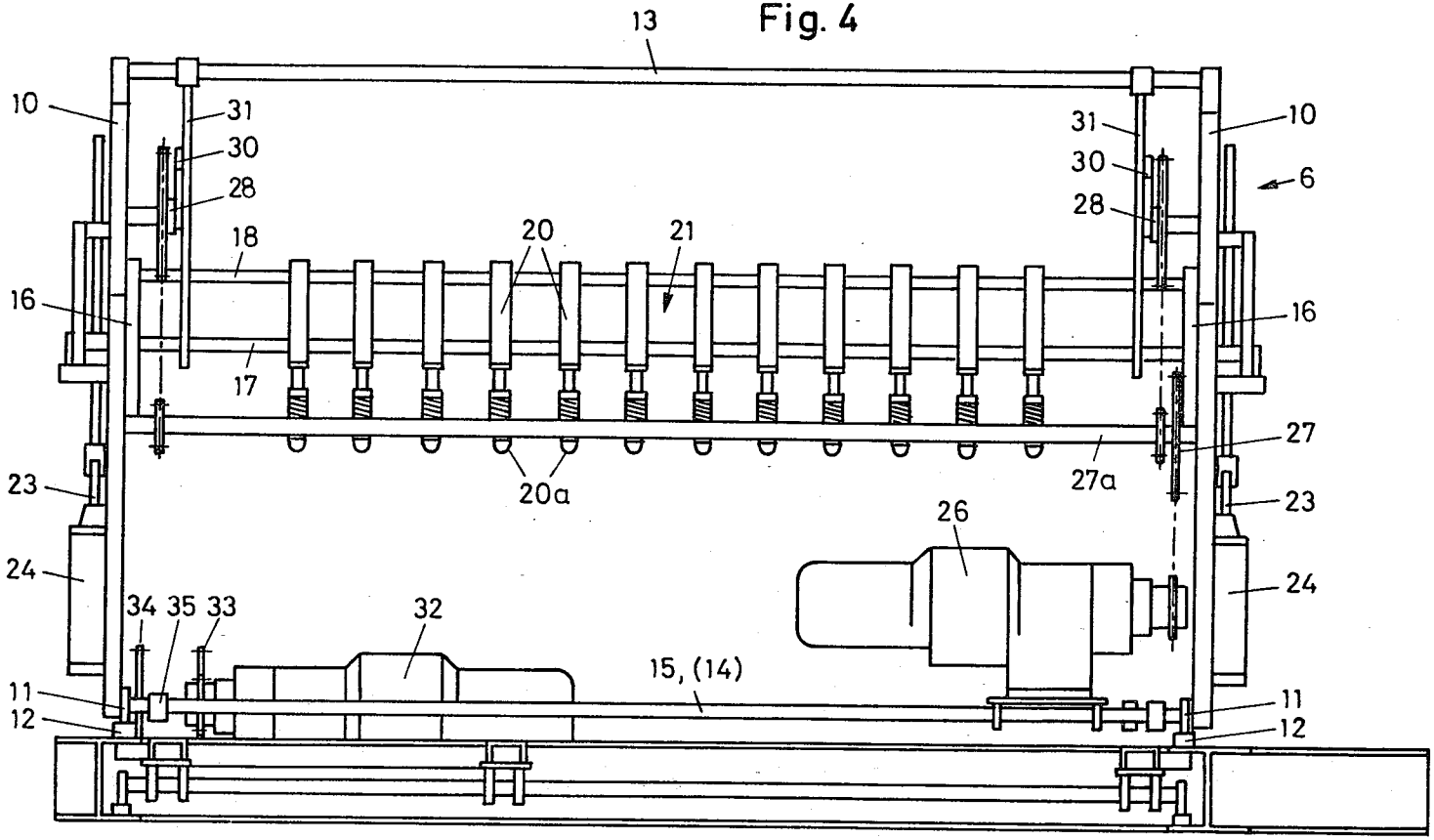
FIG. 4 shows a rear view of the transfer system according to FIGS. 2 and 3.

FIGS. 2, 3 and 4 show the transfer system, which has lateral walls 10 placed on rails 12 with rollers 11, with the rails being fastened on girders 12*a*. The lateral walls 10 are rigidly connected with each other by rods 13, 14, 15. Two shields 16 are pivotally attached to the two lateral walls 10, and are also rigidly connected with each other by lateral rods. Two further lateral rods 17, 18 are equipped with gripping arms 20 and together form a gripping beam designated by reference numeral 21. The two shields 16 have, as described in detail in U.S. Pat. No. 3,386,561, notches 22 in which the ends of the rods 17, 18 are guided in such a manner that the gripping beam 21 can perform a vertical lift. The drive of the gripping beam 21 is effected by piston rods 23 of pneumatic cylinders 24. During this vertical lift, a row of springs 3 is seized by the heads 20*a* of the gripping arms 20 and pulled out of one of the conveyor belt pairs 4 or 5, respectively. When the gripping beam 21 has reached its top position, a horizontal advance motion is initiated to introduce the row of springs between guides 25 of the spring core assembly machine 7, which is not shown in detail. Such horizontal motion is also described in U.S. Pat. No. 3,386,561. In the present invention a crank 28 pivotally coupled with a connecting rod 30 by a journal 29 is driven by a geared motor 26 through a transmission gear 27 and a shaft 27*a*. The connecting rod swings an arm 31 during each 360 degree rotation of journal 29, from the fully drawn position into the chain line position and back.

To enable the gripping arms 20 of the beam 21 to seize, in turn, a row of springs from the conveyor belt pair 4 and, subsequently, from the conveyor belt pair 5, and to introduce them into the machine 7, a geared motor 32 is connected, in a stationary manner, with the girders 12*a* for the rails 12 and drives a crank 34 through a transmission gear 33. The crank 34 is connected with a journal at the end of the rod 15 of the transfer system 6 through a connecting rod 35. The crank 34 always performs only one 180 degree turn. In this way the entire transfer system 6 is moved back and forth between the positions shown in FIGS. 2 and 3.

By means of a known program control, each working lift of the gripping beam 21 is followed by a half turn of the crank 34 whereby the transfer system 6 is moved by the distance A separating the two conveyor pairs 4, 5.

As can be seen from FIG. 1, the conveyor belt pairs 4, 5 have a rerouting zone 40 so that they can feed the rows of springs to the transfer system 6 while running closely next to and parallel to each other. To avoid any shifting of the individual springs 3 when passing through the rerouting zone 40 owing to the longer path on the outer curve of the conveyor belt portion and to ensure that they remain directed vertically to the conveyor belt pairs with their longitudinal axes, special supporting means are provided for the springs 3.

Figure 5:
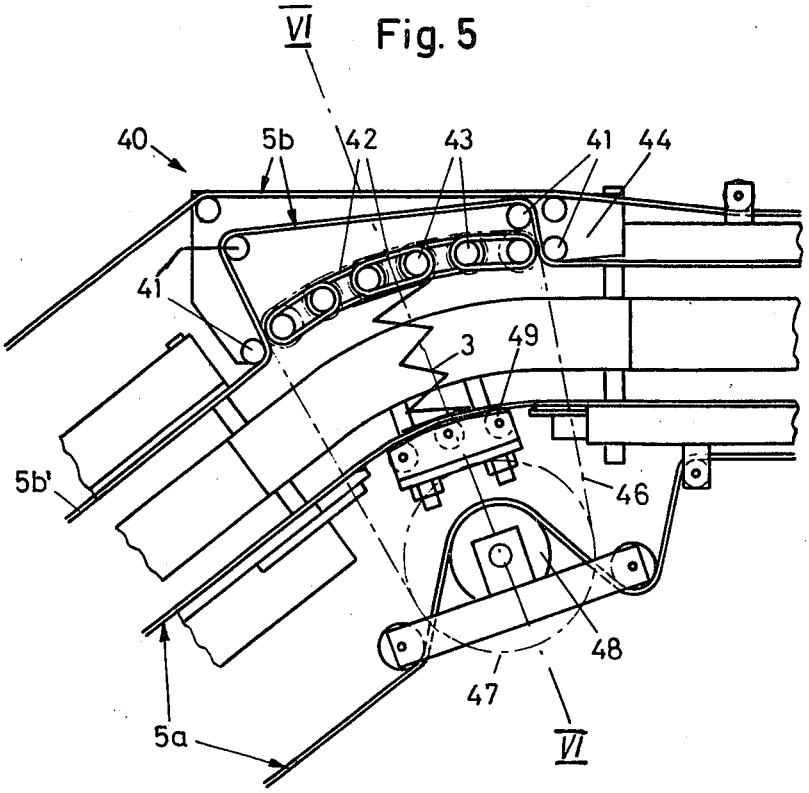
FIG. 5 shows a top view of the rerouting curve of a conveyor belt pair.
Figure 6:
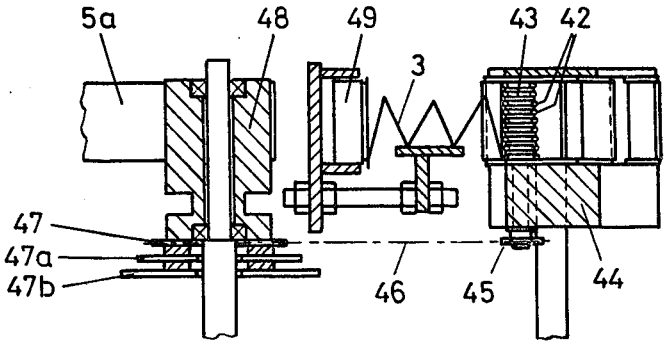
FIG. 6 shows a cross-section through line VI-VI in FIG. 5.

As shown in FIGS. 5 and 6 the taut side 5*b*′ of the conveyor belt 5*b* is led out of the transporting range of the bent zone by four rerouting rollers 41. The end rings of the springs 3 on the outside of the curve are supported here by a number of endless belts 42, for example rubber belts, which are guided in grooves of driven rollers 43. These rollers 43 rest in a support 44 (FIG. 6) and have a chain wheel 45 at their lower ends which is connected with a driving sprocket 47 by an endless chain 46. The sprocket 47 is connected with a roller 48 driven by the conveyor belt 5*a*. The drive of the rollers 43 with their belts 42 is effected in such a way that a somewhat higher driving speed is applied to the end ring of each spring 3 on the outside curve than to the end ring on the inside curve. The latter is supported by the conveyor belt 5*a* in the rerouting zone which is guided around several supporting rollers 49. The relative driving speed of the rollers 43 can be adjusted to different heights of the springs 3 by switching the chain 46 to a selected one of the additional sprockets 47*a* and 47*b* having different diameters.

What is claimed is:

1. An apparatus for supplying spiral wire springs (3) from a spring coiling machine to a spring core assembly machine (7), the spring coiling machine feeding an endless conveyor belt pair which supports end rings of the springs, said conveyor belt pair supplying springs in a row to a transfer system which removes a row of springs at a time from the conveyor belt pair and delivers said row into the spring core assembly machine by means of a plurality of gripping arms (20), wherein the transfer system is movable towards and away from the spring core assembly machine, characterized by:

(a) two spring coiling machines (1, 2) each supplying an associated endless conveyor belt pair (4, 5), (b) the two conveyor belt pairs being arranged in parallel to each other in the area of the transfer system (6), and (c) the transfer system including a plurality of gripping arms (20) and being periodically driven such that said gripping arms alternately remove a row of springs first from one and then from the other conveyor belt pair (4, 5).

2. An apparatus according to claim 1, wherein the two conveyor belt pairs are arranged in a Y configuration, each having two straight runs disposed at an angle to each other, and further comprising auxiliary support means (42, 43) for the springs arranged in a juncture or rerouting zone (40) of the y configuration.

3. An apparatus according to claim 2, further comprising diverting rollers (41) for guiding each outer conveyor belt run out of contact with the springs in the rerouting zone, and wherein said auxiliary support means comprises a plurality of driven rollers (43) connected with each other by endless belts (42).

4. An apparatus according to claim 3, further comprising means for driving the driven rollers (43) at a speed which gives end rings of the springs (3) on the outer belt run a higher speed than end rings on the inner belt run.

* * * * *